United States Patent [19]

Caine et al.

[11] Patent Number: 4,780,050

[45] Date of Patent: Oct. 25, 1988

[54] SELF-PRIMING PUMP SYSTEM

[75] Inventors: Gerard Caine, Rockford; Duane Mosure, Poplar Grove, both of Ill.; Thomas Sailer, Amherst, Ohio; Thomas Tyler, Rockford, Ill.

[73] Assignee: Sundstrand Corporation, Rockford, Ill.

[21] Appl. No.: 104,571

[22] Filed: Oct. 1, 1987

Related U.S. Application Data

[63] Continuation of Ser. No. 812,839, Dec. 23, 1985, abandoned.

[51] Int. Cl.[4] ..... F01D 1/12

[52] U.S. Cl. ..... 415/52; 415/11; 415/143; 55/159

[58] Field of Search ..... 415/11.52, 53 R, 143; 55/159, 218

[56] References Cited

U.S. PATENT DOCUMENTS

| | | | |
|---|---|---|---|
| 1,461,622 | 7/1923 | La Bour | 415/11 |
| 1,824,465 | 9/1931 | Carter, Jr. | 415/11 |
| 1,837,697 | 12/1931 | Wood | 415/11 |
| 1,840,257 | 1/1932 | Saxe et al. | 417/200 |
| 1,978,400 | 10/1934 | Burks | 415/11 |
| 1,997,418 | 4/1935 | Hornschuch et al. | 415/11 |
| 2,059,288 | 11/1936 | Stratton | 415/11 |
| 2,061,521 | 11/1936 | Saxe | 415/11 |
| 2,166,530 | 7/1939 | Morgan | 417/200 |
| 2,391,769 | 12/1945 | Campbell | 415/11 |
| 2,400,434 | 5/1946 | Nelson | 428/421 |
| 2,420,420 | 5/1947 | Durdin, Jr. | 415/121 R |
| 2,639,671 | 5/1953 | Wagner | 415/11 |
| 2,757,681 | 8/1956 | Jacuzzi | 415/11 |
| 2,897,764 | 8/1959 | Tracy | 417/83 |
| 3,078,806 | 2/1963 | Marlowe | 415/11 |
| 3,270,678 | 9/1966 | La Monica | 415/206 |
| 3,272,137 | 9/1966 | Maitlen et al. | 415/157 |
| 3,381,618 | 5/1968 | Napolitano | 415/11 |
| 3,519,369 | 7/1970 | Weis | 417/36 |
| 3,591,316 | 7/1971 | Piccirilli | 417/364 |
| 3,726,618 | 4/1973 | Diemas | 415/11 |
| 3,741,675 | 6/1973 | Porter et al. | 415/11 |
| 4,027,993 | 6/1977 | Wolff | 415/1 |
| 4,149,825 | 4/1979 | Grennan | 415/53 R |
| 4,255,079 | 3/1981 | Piegza | 415/11 |
| 4,375,938 | 3/1983 | Dussourd | 415/53 R |
| 4,642,023 | 2/1987 | Dunn | 415/143 |

FOREIGN PATENT DOCUMENTS

| | | | |
|---|---|---|---|
| 750140 | 7/1980 | U.S.S.R. | 415/52 |
| 817321 | 3/1981 | U.S.S.R. | 415/52 |

*Primary Examiner*—Robert E. Garrett
*Assistant Examiner*—John T. Kwon
*Attorney, Agent, or Firm*—Wood, Dalton, Phillips, Mason & Rowe

[57] ABSTRACT

To achieve priming during start-up and repriming during operation, a self-priming pump system is provided. The self-priming pump system includes a discharge priming reservoir for storing priming liquid for a pump. The discharge priming reservoir has an inlet in communication with the outlet of the pump for receiving priming liquid from the pump and has an outlet in communication with the pump upstream of an impeller and downstream of a liquid supply reservoir for supplying the priming liquid to the pump. The self-priming pump system is operable to separate air from priming liquid in the discharge priming reservoir during recirculation of priming liquid. In addition, a priming valve is disposed between the discharge priming reservoir and the pump to control circulation of priming liquid through the self-priming pump system.

9 Claims, 1 Drawing Sheet

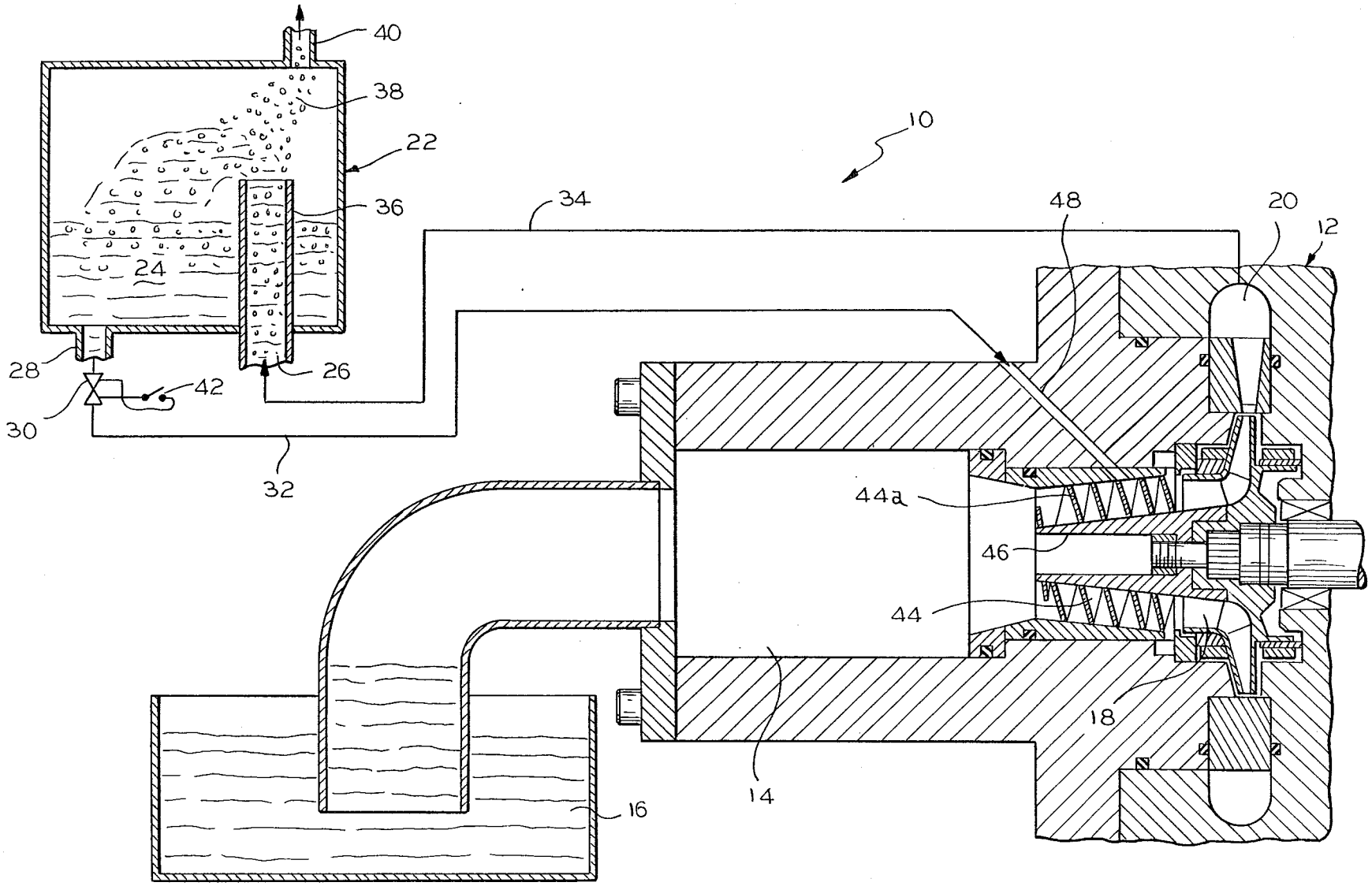
10
12
14
16
18
20
22
24
26
28
30
32
34
36
38
40
42
44
44a
46
48

SELF-PRIMING PUMP SYSTEM

This application is a continuation of application Ser. No. 812,839, filed Dec. 23, 1985, now abandoned.

FIELD OF THE INVENTION

This invention relates to a pump system, and more specifically, to a self-priming pump system.

BACKGROUND OF THE INVENTION

In many pump systems, the pump must draw liquid through suction from a lower level during normal operation but the pump must first be filled with liquid to create suction sufficient to maintain a steady flow of liquid into the pump inlet. If the pump is shut down and/or otherwise drained of liquid, insufficient suction will be generated once the pump is again in operation to cause self-priming, i.e., to draw the liquid up to the level of the pump by purging air in the pump inlet.

In one particular application, the need for high speed centrifugal pump priming is especially critical. Specifically, fuel pumps utilized in aircraft subjected to a wide variety of manuevers such as the steep banks, climbs, rolls, dives and the like performed by military aircraft can and do loose prime during flight in addition to dry start-up conditions. As a rsult, the impeller of the pump must be wetted so suction can be generated and air in the pump inlet can be purged.

Among the many attempts to provide a self-priming pump system is the one disclosed in Wood U.S. Pat. No. 1,837,697. The self-priming pump disclosed therein has a priming chamber which is formed such that air collects in the upper portion for subsequent discharge and liquid remains in the lower portion for use in priming. Other means of self-priming a centrifugal pump include that disclosed in Porter et al U.S. Pat. No. 3,741,675. The self-priming pump disclosed therein utilizes an automatic air release valve connected to the discharge side of the pump for venting air from the system during the priming cycle. Still other self-priming pump systems are disclosed in U.S. Pat. Nos. 1,461,622; 1,997,418; 2,059,288; 2,391,769; 3,078,806; 3,381,618; 3,726,618; and 4,255,079.

In providing a self-priming pump system for aircraft fuel supply, a problem is to generate and maintain sufficient suction during dry pump start-up to achieve self-priming. It is a related problem to reprime the pump during operation particularly during aircraft manuevers that can cause fuel to drain from the pump and inlet line whereby the inlet line can be filled with air. Moreover, another problem is to achieve self-priming in an aircraft fuel system with a simplified design that reduces weight and cost.

While overcoming problems of this type, it is also important to provide self-priming of sufficient capacity for an aircraft fuel system so that it is capable of quickly purging air from the pump inlet. It is also desirable to provide self-priming operation upon demand, but operational only when needed in order to eliminate the additional power consumption, size and weight of the pump drive or motor after the pump is primed or reprimed and the self-priming function is then not needed. Further, it is desirable to provide a self-priming pump which is efficient so that the self-priming function does not severely reduce the overall efficiency nor so increase the size, weight, or power consumption of the pump. It is further desirable to eliminate the need for a check valve on the pump inlet and to separate, conserve and recirculate the priming liquid to reduce the volume and weight of priming liquid and its reservoir. Still further, it is desirable to provide a self-priming pump where the self-priming apparatus does not compromise the suction capabilities of the pump.

The present invention is directed to overcoming the above stated problems and accomplishing the stated objects.

SUMMARY OF THE INVENTION

An exemplary embodiment of the invention achieves the foregoing objects in a self-priming pump system of unique construction utilizing a pump having an impeller disposed between an inlet in communication with a liquid supply reservoir and an outlet. It further includes a discharge priming reservoir for storing priming liquid for the pump with the discharge priming reservoir having an inlet in communication with the outlet of the pump for receiving priming liquid from the pump and also haing an outlet in communication with the pump upstream or midstream of the impeller and downstream of the liquid supply reservoir for supplying priming liquid to the pump. Moreover, the self-priming pump system is highly effective for establishing and maintaining prime since the discharge priming reservoir has means for separating air from priming liquid received from the outlet of the pump before returning priming liquid to the inlet of the pump.

In the exemplary embodiment, the self-priming pump system further includes a priming valve disposed between the discharge priming reservoir and the pump. The priming valve is adapted to be open to allow priming liquid to circulate from the discharge priming reservoir to the pump upstream of the impeller, through the impeller, and through the outlet of the pump back to the discharge priming reservoir. With this construction, the impeller causes air in the pump inlet to be entrained in the priming liquid for removal in the discharge priming reservoir.

In a preferred embodiment, the discharge priming reservoir is normally disposed above the pump and has an inlet conduit in communication with the pump outlet and an outlet conduit in communication with the rotating elements of the pump between the pump inlet and the impeller discharge. With the priming valve disposed in the inlet conduit between the discharge priming reservoir and the pump, the priming valve is adapted to be opened to allow priming liquid to flow freely first by means of gravity, then by pump pressure, for circulation from the discharge priming reservoir, through the inlet conduit, and to the pump at the inducer.

With or without a separable inducer, the self-priming pump system is well adapted for circulating priming liquid to remove air from the pump inlet to achieve priming. This is achieved in a simplified design which is nevertheless effective in accomplishing the objective of self-priming, either during start-up or operation of a centrifugal pump. Moreover, because of the unique advantages of the self-priming pump system, it is well suited for use in an aircraft fuel system among many other potential applications.

Other objects and advantages will become apparent from the following specification taken in connection with the accompanying drawing.

DESCRIPTION OF THE DRAWING

The drawing is a partially schematic cross sectional view illustrating a self-priming pump system in accordance with the present invention.

DESCRIPTION OF THE PREFERRED EMBODIMENT

An exemplary embodiment of a self-priming pump system is illustrated in the drawing. The pump system 10 includes a pump 12 generally of conventional construction with the exception of the components described herein, and the pump 12 has an inlet 14 in communication with a liquid supply reservoir 16 and an impeller 18 disposed between the inlet 16 and an outlet 20. A discharge priming reservoir 22 is provided to store priming liquid as at 24 for the pump 12 and ha an inlet 26 in communication with the outlet 20 of the pump 12 for receiving priming liquid from the pump and an outlet 28 in communication with the pump 12 upstream of the impeller 18 and downstream of the liquid supply reservoir 16 for supplying priming liquid to the pump 12. The pump system 10 also includes a priming valve 30 disposed between the discharge priming reservoir 22 and the pump 12 adapted to be pened to allow priming liquid as at 24 to circulate from the discharge priming reservoir 22 to the pump 12 upstream of the impeller 18, through the impeller 18, and through the outlet 20 of the pump 12 back to the discharge priming reservoir 22. With this arrangement, the inducer and impeller 18 (or rotating pump elements) cause air in the pump inlet 14 to be entrained in the priming liquid for removal in the discharge priming reservoir 22, and circulation of the priming liquid removes air from the pump inlet 14 to achieve priming.

The relative position of the pump 12, liquid supply reservoir 16, and discharge priming reservoir 22 has been accurately illustrated to the extent possible within the size constraints of the drawing. It will be appreciated, however, that the pump 12 is normally disposed above the liquid supply reservoir 16 and below the discharge priming reservoir 22. By so positioning the discharge priming reservoir 22, priming liquid as at 24 can flow by gravity to the pump 12 when the priming valve 30 is opened assuming the pump 12 is not already fully primed, as will be described in detail hereinafter.

As shown in the drawing, the liquid supply reservoir 16 is in communication with the pump 12 through the inlet 14. It will also be appreciated from the schematic representation that the discharge priming reservoir 22 is in communication with the inlet side of the pump 12 through an outlet conduit 32 and is in communication with the outlet side of the pump 12 through an inlet conduit 34. Moreover, the priming valve 30 is disposed in the inlet conduit 32 and is adapted to be opened to allow priming liquid as at 24 to flow freely through the inlet conduit 32 for circulation through the pump 12.

Referring to the discharge priming reservoir 22, it includes means for separating air from priming liquid. In the simplest system, the vertical tube 36 is arranged such that priming liquid and air mixture which is returned under pressure from the pump 12 back to the discharge priming reservoir 22 flows in a turbulent mixed condition. However, when the liquid and air mixture reaches the greater cross sectional area and volume of the discharge priming reservoir 22, it slows down to a less turbulent condition and the action of gravity causes the liquid to settle below the air. In the system illustrated, the air can be vented from the discharge priming reservoir 22 through a suitable vent 40 under the pressure supply to the mixture by the pump 12 while the liquid is returned to the pump 12 to continue the turbulent mixing and priming or repriming function. Other means can also be employed to separate the liquid from air such as causing the mixture to swirl in the vertical tube 36 and discharge priming reservoir 22 to cause the liquid and air mixture to separate by centrifugal forces.

As shown, the pump system 10 also includes means for opening and closing the priming valve 30 during operation of the pump 12. Preferably, the opening and closing means comprises a controlled switch 42 through which, in an application where the self-priming pump system 10 is used as a fuel pump in aircraft, controls or the pilot can open and close the priming valve 30 as required to maintain the pump 12 in a fully primed condition. Moreover, the priming valve 30 is formed such that back pressure through the outlet conduit 32 will maintain it fully closed when the pump 12 is fully primed and up to pressure despite any attempt to open it through the switch 42.

In a preferred embodiment, the pump 12 has an inducer 44 disposed between the inlet 14 and the impeller 18. The inducer 44 is preferably but not necessarily frustoconical in shape with an enlarged taper from the inlet side of the pump 12 toward the outlet side thereof and includes a plurality of sharp, helical blades **44*a* disposed about a tapered hub or shaft 46. As shown, the outlet conduit 32 is in communication with the pump 12 through a port 48 at a point intermediate the length of the inducer 44. However, the outlet conduit 32** need only be in communication with some point along the hydraulic path of the rotating pump elements downstream of the entrance to those elements in order to function in the intended fashion.

With these features of construction, the priming valve 30 can be opened by means of the switch 42 to achieve priming of the pump 12 by allowing priming liquid as at 24 to flow freely through the inlet conduit 32 for circulation from the discharge priming reservoir 22 to the pump 12 at the inducer 44. The priming liquid is then mixed with air drawn from the inlet 14 of the pump 12 by reason of the slicing or "chopping" action of the helical blades **44*a* of the inducer 44 on the recirculated priming liquid which causes it to mix with air due to the passing of the helical blades 44*a* of the inducer 44 past the priming liquid recirculation point, i.e., the port 48, as the helical blades 44*a* are rotated by the tapered hub or shaft 46. The priming liquid and air mixture is then impelled through the inducer 44 and the impeller 18, and through the outlet 20 of the pump 12 back to the discharge priming reservoir 22 throught the inlet conduit 26 and the vertical tube 36. As a result, the inducer 44 and impeller 18 cause air in the pump inlet 14 to be entrained in th.e priming liquid and pressurized for removal in the discharge priming reservoir 22 after it flows through the vertical tube 36**.

As previously mentioned, the pump 12 is particularly suited for use as a centrifugal fuel pump for an aircraft where the liquid supply reservoir 16 comprises a fuel tank for the aircraft. Of course, the fuel tank will be configured in conventional fashion for aircraft rather than in the schematic form of the liquid supply reservoir 16, as will the connection between the tubing 50 leading from the liquid supply reservoir 16 to the pump inlet 14. In addition, it will be appreciated that the exact configuration of the various components including the pump 12 and the discharge supply reservoir 22 can be varied from those shown schematically in the drawing.

As previously mentioned, the outlet conduit 32 is in communication with the pump 12 through a radially disposed injection port 48 intermediate the length of the inducer 44 upstream of the pump inlet 14. It has also been mentioned that the inlet conduit 34 is in communication with the inlet port 26 of the discharge priming reservoir 22 to accommodate flow of priming liquid returning from the pump 12 through the vertical tube 36. In this manner, priming liquid and air mixture received from the pump 12 separates in the discharge priming reservoir 22 sufficient to remove air from priming liquid before return to the pump 12.

When the air has been removed from the priming liquid, the vent 40 accommodates release of the removed air to atmosphere externally of the discharge priming reservoir 22, although the vent 40 can be optional and can be provided with a check valve to prevent the escape of priming liquid therethrough. The outlet conduit 32 is in communication with the outlet port 28 through the priming valve 30 which is the means by which priming liquid is returned to the pump 12. Since the outlet conduit 32 is in communication with priming liquid below the froth and in remote relation to the vent 40, it can carry priming liquid without air to the pump 12 for further entrainment of air during a priming operation.

Referring once again to the priming valve 30, it is preferably an electrically operated solenoid actuated valve. As previously suggested, the valve 30 is controlled by means of a switch 42 which, in the case of use of the pump system 10 in aircraft could be actuated by pressure or located in proximity to the pilot. As mentioned, the valve 30 is responsive to pressure in the pump 12 in check valve fashion to remain in a fully closed position whenever the pump 12 is fully primed, filled with liquid and up to normal discharge pressure.

As will be appreciated, the present invention accomplishes the objective of providing a centrifugal pump having an inducer in integrally associated relationship with an impeller with pressurized liquid delivered directly into the inducer for mixing and priming. It also accomplishes the objective of providing a discharge priming reservoir adapted to store fluid for use in priming where the reservoir also acts as a fluid/air separator and as a recirculation chamber during priming. With the discharge priming reservoir, the inducer receives the priming liquid under pressure and the priming liquid is subsequently returned for entraining and removal of air in the pump inlet 14 and inlet piping to the tank 16.

With the present invention, it is now possible to overcome the fact that a dry centrifugal pump does not generate enough suction to prime under significant dry lift conditions. The self-priming pump system of the present invention provides a pump that, when having a reservoir with some fluid therein so as to be wet, easily draws air up the pump inlet by recirculating priming fluid in a loop consisting of the inlet side of the pump, the inducer, the impeller, the outlet side of the pump, and the discharge priming reservoir. By utilizing the discharge priming reservoir, the air drawn up the pump inlet is removed from the priming liquid and the priming liquid is recirculated to the inlet side of the pump when needed.

With the construction of the preferred embodiment, the helical blades 44*a* of the inducer 44 ahead of the port 48 impells the priming liquid which is recirculated for priming or repriming into the following portion of the inducer 44 and then into the impeller 18. In other words, the priming liquid is impelled away from the pump inlet 14 and the inlet piping leading to the tank 16 so that the recirculated priming liquid will not be lost by running back down the inlet pipe into the inlet supply reservoir or tank 16. As a result, for moderate suction lifts, the need for a check valve in the pump inlet 14 is eliminated and the problems of unreliability, pressure drop and extra cost, weight and envelope of an inlet check valve are eliminated.

While in the foregoing there has been set forth a preferred embodiment of the invention, it is to be understood that the invention is only to be limited by the spirit and scope of the appended claims.

We claim:

1. A system for priming a pump during startup and repriming a pump during operation, comprising:

a pump having an inlet and an outlet, an impeller disposed between said inlet and said outlet, and an inducer disposed between said inlet and said impeller;

said inlet, inducer, impeller and outlet defining a primary flow path through said pump;

a liquid reservoir in communication with said pump through said inlet;

a recirculation loop including a separate discharge priming reservoir outside of said primary flow path for storing priming liquid for said pump, said recirculation loop having an inlet conduit extending from said separate discharge priming reservoir and in communication with said pump at said outlet for delivering priming liquid from said pump to said separate discharge priming reservoir and said recirculation loop also including an outlet conduit extending from said separate discharge priming reservoir and in communication with said pump downstream of said inlet between the ends of said inducer for delivering priming liquid from said separate discharge priming reservoir directly to said pump, said recirculation loop including means outside of said primary flow path and associated with said separate discharge priming reservoir for separating air from priming liquid delivered from said pump;

a priming valve disposed in said outlet conduit between said separate discharge priming reservoir and said pump, said priming valve being adapted to be opened at startup for priming said pump and during operation for repriming said pump by allowing priming liquid to flow freely through said inlet conduit for circulation from said separate discharge priming reservoir directly to said pump at said inducer, through said inducer and said impeller, and through said outlet of said pump back to said separate discharge priming reservoir, said inducer and impeller causing air in said inlet of said pump to be entrained in and pumped with said priming liquid for removal and venting of air from said separate discharge priming reservoir; and means for opening and closing said priming valve during operation of said pump, said opening and closing means being adapted to ensure said pump is always maintained in a fully primed condition.

2. The self-priming pump system as defined by claim 1 wherein said pump comprises a contrifugal fuel pump for an aircraft and said liquid supply reservoir comprises a fuel tank for said aircraft.

3. The self-priming pump system as defined by claim 1 wherein said outlet conduit is in communication with said pump through a radially disposed injection port.

4. The self-priming pump system as defined by claim 1 wherein said means for separating air from priming liquid includes an inlet port in communication with said outlet of said pump to receive said priming liquid and air from said pump.

5. The self-priming pump system as defined by claim 4 wherein said separate discharge priming reservoir includes vent means disposed above said priming liquid, said vent means accommodating release of air removed from priming liquid to atmosphere externally of said separate discharge priming reservoir.

6. The self-priming pump system as defined by claim 5 wherein said outlet conduit of said discharge priming reservoir is in communication with said priming liquid through an outlet port below the priming liquid directly surface level in remote relation to said vent means to carry priming liquid to said pump for further entrainment of air during priming.

7. The self-priming pump system as defined by claim 1 wherein said opening and closing means is responsive to fluid pressure in said pump to control operation of said priming valve.

8. The self-priming pump system as defined by claim 1 wherein said priming valve is an electrically operated solenoid actuated valve and said opening and closing means includes a switch and a check valve integrally associated with said priming valve responsive to pressure in said pump inlet.

9. The self-priming pump system as defined by claim 1 wherein said liquid supply reservoir is normally disposed below said pump and said separate discharge priming reservoir is normally disposed above said pump.

* * * * *